US005170733A

United States Patent [19]

Honma et al.

[11] Patent Number: 5,170,733

[45] Date of Patent: Dec. 15, 1992

[54] TROUSER FLY PIECE SERGING APPARATUS

[75] Inventors: Yoshiaki Honma, Chofu; Toshiaki Sawada, Toyama; Akira Hashimoto, Chofu, all of Japan

[73] Assignee: Juki Corporation & Yoshida Kogyo K.K., Tokyo, Japan

[21] Appl. No.: 757,302

[22] Filed: Sep. 10, 1991

[30] Foreign Application Priority Data

Sep. 10, 1990 [JP] Japan ..... 2-239382

[51] Int. Cl.[5] ..... D05B 37/00; D05B 27/00; D05B 35/10

[52] U.S. Cl. ..... 112/308; 112/122; 112/153

[58] Field of Search ..... 112/308, 153, 122, 122.1, 112/129, 136, 121.27, 104, 113, 265.2, 306, 121.15, 262.3

[56] References Cited

U.S. PATENT DOCUMENTS

| | | | |
|---|---|---|---|
| 3,252,437 | 5/1966 | Pickett | 112/136 |
| 3,722,441 | 3/1973 | Kitchener et al. | 112/121.15 X |
| 3,919,942 | 11/1975 | Galya et al. | 112/197 X |
| 4,152,996 | 5/1979 | Van Amburg | 112/262.3 |
| 4,181,085 | 1/1980 | Conner, Jr. | 112/308 X |
| 4,236,292 | 12/1980 | Orr et al. | 29/408 |
| 4,307,675 | 12/1981 | Off et al. | 112/308 X |
| 4,333,232 | 6/1982 | Orr et al. | 29/767 |
| 4,362,116 | 12/1982 | Sen Gupta et al. | 112/265.2 |
| 4,526,117 | 7/1985 | Willenbacher | 112/308 |
| 4,648,337 | 3/1987 | Mall | 112/153 |
| 4,722,290 | 2/1988 | Manuel et al. | 112/153 |
| 4,979,450 | 12/1990 | Dudek et al. | 112/265.2 |
| 5,069,148 | 12/1991 | Ishikawa et al. | 112/153 X |

FOREIGN PATENT DOCUMENTS

| | | |
|---|---|---|
| 3139426 | 4/1983 | Fed. Rep. of Germany . |
| 3314717 | 2/1984 | Fed. Rep. of Germany . |
| 3519344 | 4/1986 | Fed. Rep. of Germany . |
| 64-25898 | 1/1989 | Japan . |
| 1-0101493 | 7/1989 | Japan . |
| 2062707 | 5/1981 | United Kingdom . |

*Primary Examiner*—Peter Nerbun

*Attorney, Agent, or Firm*—Hill, Van Santen, Steadman & Simpson

[57] ABSTRACT

An apparatus is disclosed for automatically serging a trouser-fly piece initially along an arcuate line of stitching extending across its leading end while tracing and trimming that arcuate line in advance of serging and thereafter continuing to serge along a straight line of stitching extending parallel to one longitudinal substantially straight side edge of the trouser-fly piece. The apparatus incorporates control means including a control counter and a delay counter both operatively associated with the operation of a sewing needle so as to ensure serging of the trouser-fly piece over its full length with accurate and uniform finishing.

7 Claims, 6 Drawing Sheets

TROUSER FLY PIECE SERGING APPARATUS

BACKGROUND OF THE INVENTION

1. Field of the Invention

The present invention relates generally to serging or overedge sewing machines, and more particularly to an apparatus for serging a trouser-fly piece along an arcuate line of stitching and a contiguous substantially straight line of stitching extending along one of its longitudinal edges.

2. Prior Art

A known serging apparatus is schematically illustrated in FIGS. 6–8 inclusive of the accompanying drawings and generally designated at 100, which apparatus essentially comprises a serging unit 101 including a sewing needle 102 for forming an overedge or serge stitching S (FIGS. 7 and 8) and a feed dog 103 disposed in a table (not shown) beneath the needle 102 and cooperative with a presser foot (not shown) to advance a trouser-fly piece F through the serging unit 101, and a trimming cutter 104 disposed immediately upstream of the serging unit 101 for trimming a corner of a leading end Fa of the trouser-fly piece F. The apparatus 100 further includes an elongated guide member 105 having a guide surface 106 extending at an angle relative to a straight line L defining the path of movement of the trouser-fly piece F and extending in alignment with the needle 102 and adapted to guide the trouser-fly piece F into the serging unit 101. Designated at 107 is a fly-piece end sensor disposed diagonally to the upstream left of the sewing needle 102 for sensing the leading end Fa of the trouser-fly piece F being advanced into the serging unit 101. Upon sensing of the leading end Fa, the end sensor 107 sends an electrical signal to a controller (not shown) to start operation of the serging unit 101 not immediately but with a predetermined time lag corresponding to the length of time required for the leading end Fa of the trouser-fly piece F to arrive at the sewing needle 102 from the position of the end sensor 107. The end sensor 107 is adapted also to sense a trailing end Fa of the trouser-fly piece F and send a signal to the controller to discontinue operation of the serging unit 101 not immediately but with a certain time lag for the aforesaid reasons. Designated at 108 is a presser member generally in the form of a ball vertically movable toward and away from the trouser-fly piece F on the table by means of for example an electromagnet. Designated at 109 is a fly piece side edge sensor disposed diagonally to the upstream right of the sewing needle 102 for sensing a longitudinal side edge Fc of the trouser-fly piece F opposite to and remote from the guide member 105 and operatively associated with the controller of the serging unit 101 in such a manner that when the edge sensor 109 senses the presence of the trouser-fly piece F, the presser member 108 is held lifted in a standby position away from the trouser-fly piece F, and when the edge sensor 109 senses the absence of the trouser-fly piece F (when the trouser-fly piece F shifts off to the left of the edge sensor 109 for some reason during the serging operation), the edge sensor 109 sends a signal to the controller to lower the presser member 108 onto and press the trouser-fly piece F, whereupon the trouser-fly piece F is caused to turn about the presser member 108 counterclockwise under the influence of rotational moment produced upon advancement of the trouser-fly piece F by coaction of the feed dog 103 and the presser foot. With this rotational movement of the trouser-fly piece F, the trimming cutter 104 severs the trouser-fly piece F substantially arcuately along its leading end portion, followed by the serging of that portion as shown in FIG. 7. Thereafter, the trouser-fly piece F is oriented to move substantially in parallel with the straight path L of movement and is serged along its straight longitudinal edge until the end sensor 107 senses the trailing end Fb of the trouser-fly piece F and sends a signal to discontinue operation of the serging unit 101.

The foregoing prior art apparatus has a drawback in that since the serging unit 101 is arranged to start operation with a certain time lag upon issuance of the signal from the fly piece end sensor 107, the trouser-fly piece F can be serged from its leading end Fa (as indicated at the solid-line position in FIG. 6) if it is fed fast enough, but if it is fed too slow, the trouser-fly piece F is apt to receive the serge stitching from an end portion departing from the leading end Fa as illustrated by phantom-line in FIG. 6, with the results that there are produced trouser-fly pieces F having irregularly or otherwise defectively finished arcuate serges.

The prior art apparatus has a further drawback in that if the trouser-fly piece F is swerved or displaced from the position of the edge sensor 109 during its advancement along the straight path L after the arcuate or curved serging has been completed, the presser member 108 comes into pressure engagement with the trouser-fly piece F and causes the latter to turn counterclockwise, resulting in a trouser-fly piece F being serged objectionably arcuately along its longitudinal straight side edge Fc as indicated at Fe in FIG. 8.

SUMMARY OF THE INVENTION

With the foregoing drawbacks of the prior art in view, the present invention seeks to provide an apparatus for automatically serging a trouser-fly piece initially along an arcuate line of stitching extending across its leading end while tracing and trimming that arcuate line in advance of serging and thereafter continuing to serge along a straight line of stitching extending parallel to one longitudinal substantially straight side edge of the trouser-fly piece.

The present invention further seeks to provide a trouser-fly piece serging apparatus which incorporates control means for controlling the serging operation so that a trouser-fly piece can be serged initially arcuately at its leading end portion and subsequently linearly along its one longitudinal side edge with utmost accuracy and efficiency to provide uniformly finished serges on the trouser-fly piece.

According to the invention there is provided a trouser fly piece serging apparatus which comprises: a serging unit defining a serging station and including means for advancing an elongate rectangular trouser fly piece longitudinally through the serging station and a sewing needle for serging a substantially arcuate end portion and subsequently a substantially straight longitudinal side edge of the trouser-fly piece with a serge stitching during advancing movement of the trouser-fly piece; a trimming cutter disposed immediately upstream of the serging station and operative in synchronism with the serging unit for trimming, in advance of serging by the needle the trouser-fly piece along the substantially arcuate trimming line and subsequently along the substantially straight longitudinal side edge; a guide member disposed upstream of the serging station and having a guide surface extending at such an angle relative to a path of advancement of the trouser-fly piece that the guide surface and the path of advancement of the trouser-fly piece converge toward the serging station for guiding the trouser-fly piece into the serging station so that the trimming cutter assumes a position to conform to a curvature of the arcuate trimming line; a presser means disposed upstream of the serging station for causing the trouser-fly piece to turn in a direction to separate the trouser-fly piece from the guide surface until the trouser-fly piece is oriented to move parallel to a straight line of path of advancement extending linearly in alignment with the needle; a trouser-fly piece end sensor disposed upstream of the serging station for sensing both the leading end and a trailing end of the trouser-fly piece; a trouser-fly piece edge sensor disposed upstream of the serging station for sensing a longitudinal side edge of the trouser-fly piece and issuing an electrical signal to actuate the presser means; and a start-up sensor disposed in close proximity to and upstream of the trimming cutter for sensing the leading end of the trouser-fly piece being advanced into the serging station and issuing an electrical signal to start operation of the serging unit.

The above and other objects and features of the invention will become better understood from the following detailed description taken in conjunction with the accompanying drawings.

DETAILED DESCRIPTION OF THE INVENTION

The present invention will be described hereinbelow in detail with reference to a preferred embodiment shown in the accompanying drawings.

Figure 1:
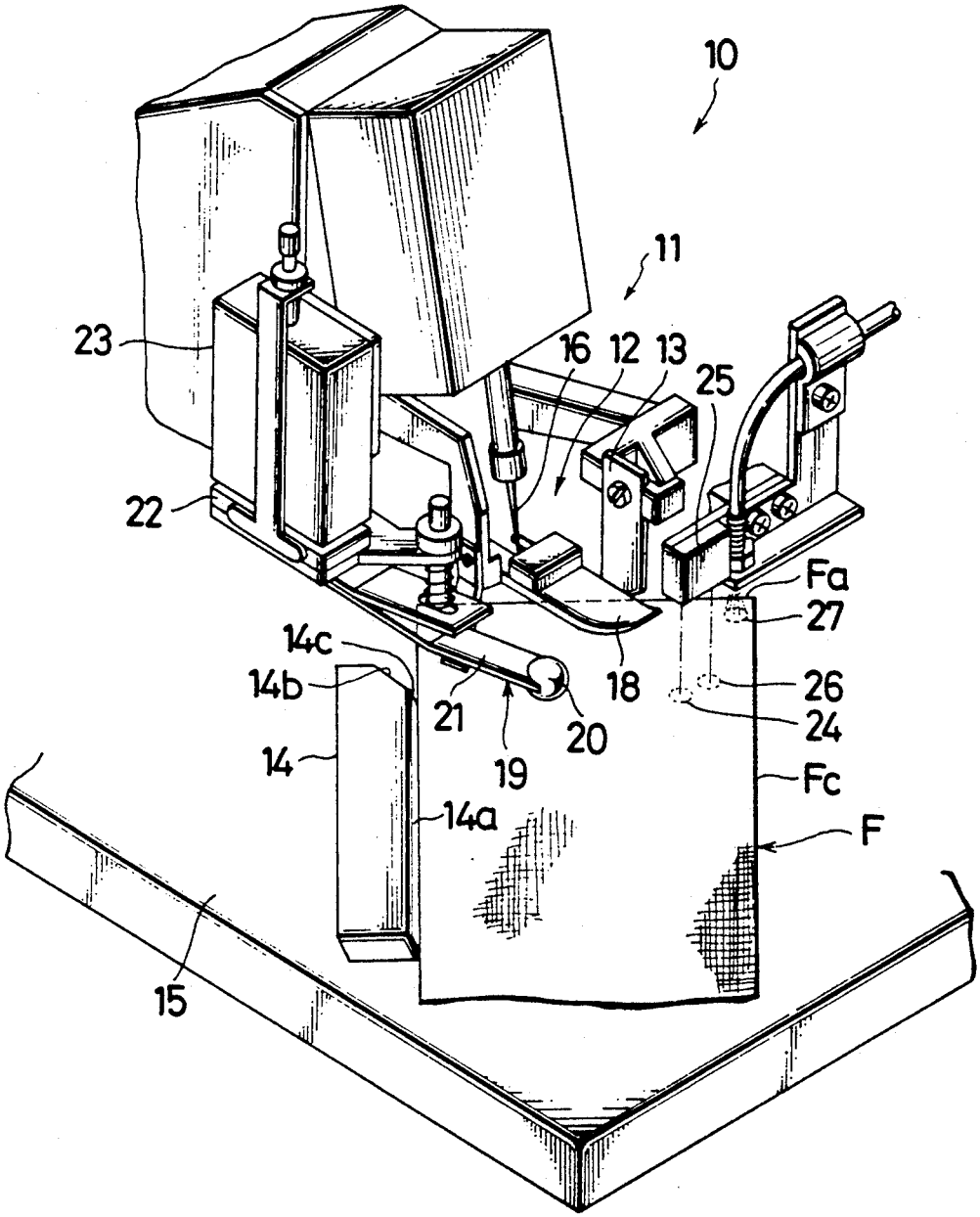
FIG. 1 is a perspective view of a main portion of an apparatus for serging a trouser-fly piece according to the invention.

As shown in FIG. 1, a trouser-fly piece serging apparatus 10 according to the present invention includes a serging unit 11 defining a serging station 12 for serging one longitudinal edge of a trouser-fly piece F as the trouser-fly piece F is advanced through the serging station 12 along a longitudinal path, a trimming cutter 13 for trimming an arcuate longitudinal end portion of the trouser-fly piece F to be serged, and a trouser-fly piece guide member 14 disposed upstream of the serging station 12 for guiding a trouser-fly piece F as it is supplied to and advanced through the serging station 12. The serging unit 11, the trimming cutter 13 and the guide member 14 are disposed on a table 15.

The serging unit 11 is a conventional serging machine which is actuated by a suitable drive such as a motor and which includes a serge stitch forming mechanism having a sewing needle 16 for forming an overedge or serge stitching S (FIGS. 4 and 5) on one longitudinal edge of a trouser-fly piece F. The serging unit 11 further includes a feed dog 17 (FIG. 2) disposed in the table 15 beneath the needle 16. The feed dog 17 cooperates with a presser foot 18 (FIG. 1) to advance the trouser-fly piece F through the serging station 12 in timed relation to the operation of the serge stitch forming mechanism. A further description as regards other component parts of the serge stitch forming mechanism is omitted as they constitute no positive part of the invention.

The trimming cutter 13 is disposed immediately upstream of the serging station 12 for trimming a corner of a leading end Fa of the trouser-fly piece F being advanced into the serging station 12. The trimming cutter 13 may be arranged to trim the trouser-fly piece F along one longitudinal side edge Fc additional to the trimming of the corner. The trimming cutter 13 is vertically reciprocated by a suitable drive means (not shown) in synchronism with the reciprocating movement of the needle 16.

A presser member 19 is provided with a ball 20 disposed close to and upstream of the serging unit 11 and vertically movable toward and away from the table 15 for forcing a portion of the trouser-fly piece F against the table 15 to cause the trouser-fly piece F to turn in one or counterclockwise direction about the same portion, as described later. The ball 20 is attached to one end of a resilient plate member 21 whose opposite end is connected to a support block 22 which is in turn connected to a piston rod (not shown) extending from a fluid-operated cylinder 23. Actuation of the cylinder 23 urges the ball 20 toward and away from the trouser-fly piece F on the table 15 in a manner hereinafter described.

The guide member 14 in the form of an elongate rectangular block includes a guide surface 14*a* extending at an angle relative to the path of advancement of the trouser-fly piece F being advanced by the serge unit 11, more specifically at such an angle that the guide surface 14*a* and the path of advancement of the trouser-fly piece F converge toward the serging station 12, for guiding the trouser-fly piece F into the serge station 12 so that the trimming cutter 13 assumes a position to conform to a curvature of a substantially arcuate trimming line Fy along which the trouser-fly piece F is trimmed and simultaneously serged.

The guide surface 14*a* of the guide member 14 guides a straight longitudinal edge Fd (FIG. 2) of the trouser-fly piece F which is opposite to the other longitudinal side edge Fc adapted to be serged. An inner corner of the leading end of the guide member 14 is beveled to form an auxiliary guide surface 14*b* extending parallel to a straight line L (FIG. 2) defining the path of movement of the trouser-fly piece F and extending linearly in alignment with the needle 16. The auxiliary guide surface 14*b* and the guide surface 14*a* of the first guide member 14 jointly define a corner 14*c* which serves as a fulcrum about which the trouser-fly piece F turns when it is advanced for the formation of the trimmed arcuate corner of the trouser-fly piece F and the serge stitching S on the trimmed arcuate corner.

Designated at 24 is a trouser-fly piece end and sensor such as a photosensitive cell disposed below the table 15 in alignment with a light source 25. The end sensor 24 is located diagonally to the upstream left of the needle 16 and adapted to sense both the leading end Fa and the trailing end Fb of the trouser-fly piece F being advanced into the serging station 12.

Figure 4:
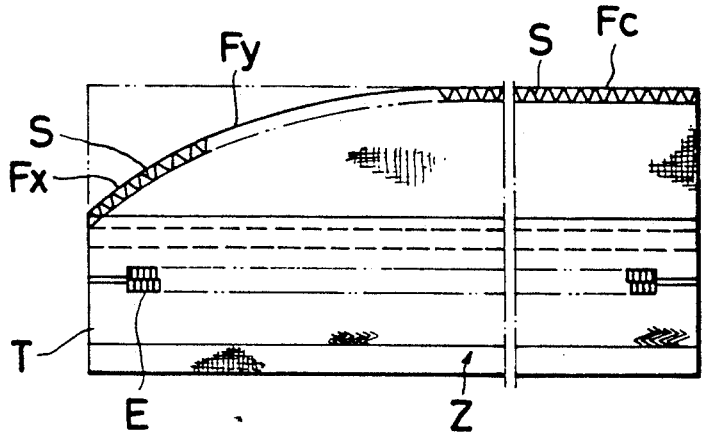
FIG. 4 is a plan view of a trouser-fly piece shown serged in timed relation to the time chart of FIG. 3.

A trouser-fly piece side edge sensor 26 similar to the end sensor is disposed diagonally to the upstream right of the needle 16 for sensing a longitudinal side edge Fc of the trouser-fly piece F opposite to and remote from the guide member 14. The edge sensor 26 is electrically connected to a controller C (shown in FIG. 9) for the serging unit 11, the arrangement being that when the edge sensor 26 senses the presence of the trouser-fly piece F, the presser member 19 is held lifted in a standby position away from the trouser-fly piece F, and when the edge sensor 26 senses the absence of the trouser-fly piece F (when the trouser-fly piece F shifts off to the left of the edge sensor 26 for some reason during the serging operation), the edge sensor 26 sends a signal to the controller to actuate the cylinder 23 to lower the presser member 19 onto and press the trouser-fly piece F, whereupon the trouser-fly piece F is caused to turn about the presser member 19 counterclockwise under the influence of rotational moment produced upon advancement of the trouser-fly piece F by coaction of the feed dog 17 and the presser foot 18. In other words, the trouser-fly piece F is caused to turn in a direction to separate from the guide surface 14*a* of the guide member 14. With this rotational movement of the trouser-fly piece F, the trimming cutter 13 severs the trouser-fly piece F substantially arcuately along its leading end portion, followed by the serging of that portion as shown in FIG. 4.

Figure 3:
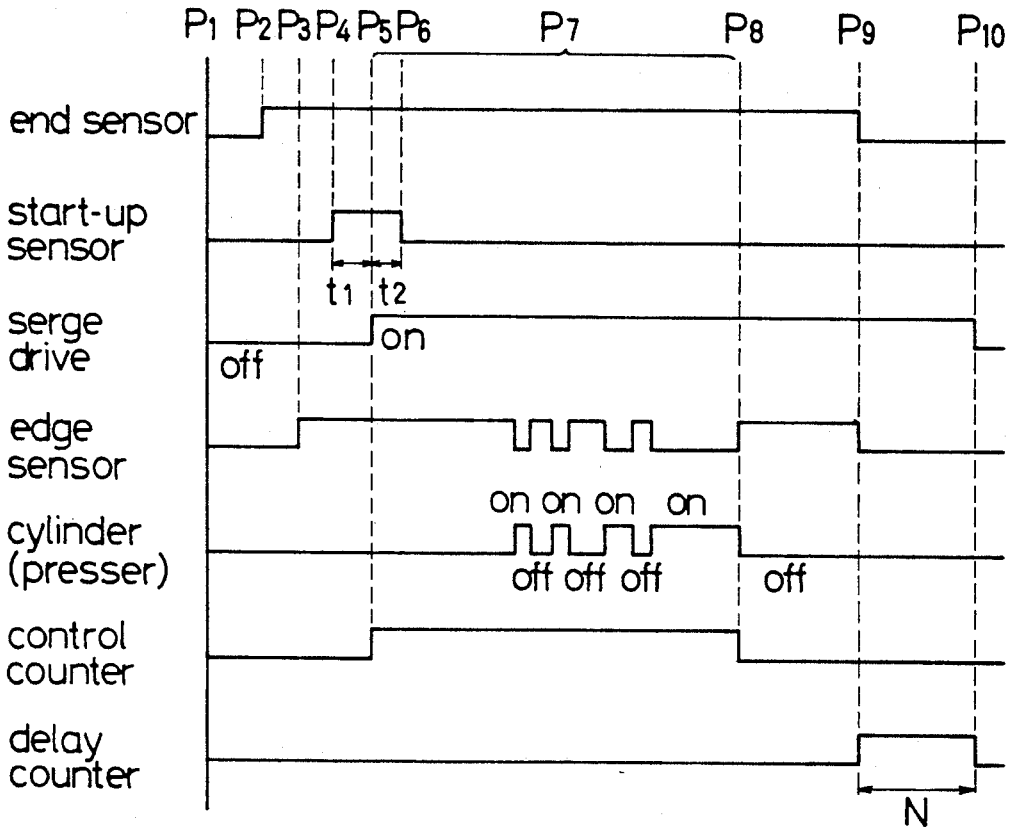
FIG. 3 is a time chart utilized to explain the time sequence of operation of the various operating members of the apparatus.

Thus, actuation of the cylinder 23 is substantially concurrent with the "on" and "off" condition of the edge sensor 26 which repeats as depicted in FIG. 3 until the serging of the trouser-fly piece F along its arcuate or curved end portion Fx is completed.

Figure 2:
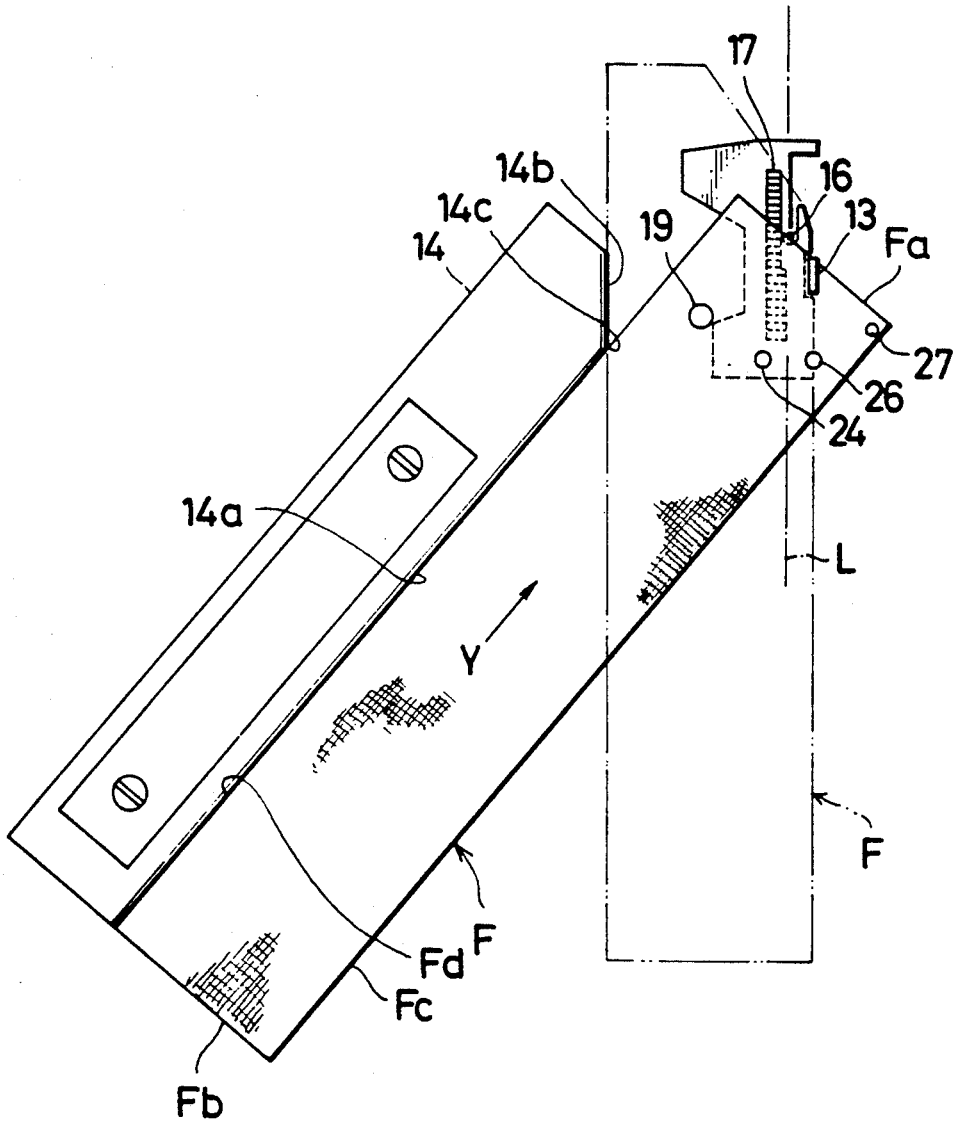
FIG. 2 is a schematic plan view utilized to illustrate the general geometric relationship between a trouser-fly piece and various operating members of the apparatus.

According to an important feature of the invention, there, is provided a start-up sensor 27 disposed in close proximity to and diagonally to the upstream right of the trimming cutter 13 and the serging unit 11 and adapted to sense the leading end Fa of the trouser-fly piece F being advanced into the serging station 12 as shown in FIGS. 1 and 2.

Upon sensing of the leading end Fa, the start-up sensor 27 sends an electrical signal to the controller C of the serge stitch forming mechanism to start a motor (not shown) to actuate the serging unit 11 and the trimming cutter 13 in synchronism with each other. The cutter 13 thus actuated trims the trouser-fly piece F along the arcuate or curved end portion Fx, while at the same time, the serging unit 11 forms an overedge or serge stitching S (FIG. 4) on the arcuate portion Fx.

The controller includes a control counter DC (shown in FIG. 9) for setting the number of cycles of vertical reciprocation or strokes of the sewing needle 16 which is required to complete the serging of the entire arcuate portion Fx of the trouser-fly piece F. A typical preset number of strokes of the needle 16 set in the control counter is thirty (30) as in the present embodiment, though dependent upon the size of a trouser-fly piece F to be processed. When the number of counted strokes of the needle 16 is equal to the preset value, the control counter energizes a relay to put the edge sensor 26 in "of" condition or out of service so that the ball 20 of the presser member 19 is kept lifted in a standby position away from the trouser-fly piece F to prevent the latter from continuing rotational movement.

The controller further includes a delay counter DC (shown in FIG. 9) for setting the number of cycles of vertical reciprocation or strokes of the needle 16 which is required to continue operation of the serging unit 11 for a certain period of time (as indicated by N in FIG. 3) after the end sensor 24 has sensed the trailing end Fb of the trouser-fly piece F in order to effect serging fully up to the trailing end Fb. This is because the end sensor 24 is spaced a distance from the serging station 12. A typical preset number of strokes of the needle 16 set in the delay counter is ten (10) as in the present embodiment, which is however dependent upon the distance between the end sensor 24 and the serging unit 11, more specifically the needle 16. When the number of counted strokes of the needle 16 is equal to the preset value, the delay counter energizes a relay to stop the operation of the serging unit 11.

The control counter and the delay counter may be replaced by respective timers to perform the intended functions.

Figure 9:
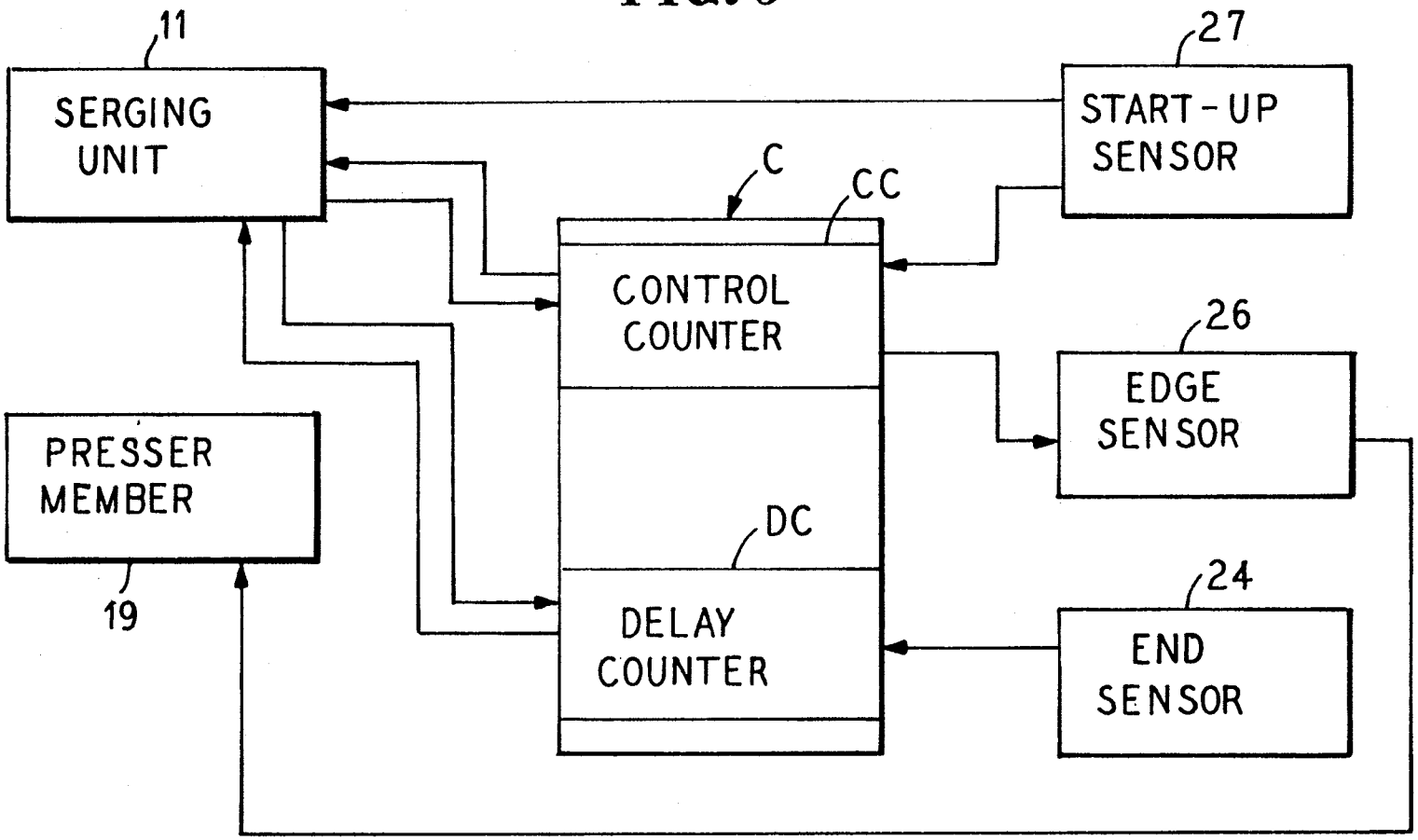
FIG. 9 is a schematic diagram of the present invention.

Operation of the trouser-fly piece serging apparatus 10 of the foregoing construction will be described below with reference to the time chart of FIG. 3 and the schematic diagram of FIG. 9.

A trouser-fly piece F to be processed on the apparatus 10, as shown in FIG. 4, has an elongate rectangular shape. A slide fastener stringer Z including a pair of stringer tapes T with respective rows of coupling elements E mounted on the inner longitudinal edges thereof is sewn to the trouser-fly piece F by a pair of straight lines of stitches (not designated). The trouser-fly piece serging apparatus 10 of the invention can be of course used with a trouser-fly piece F devoid of a slide fastener stringer Z.

As shown in FIG. 1, an elongate rectangular trouser-fly piece F is disposed flatwise on the table 15 and then manually guided longitudinally along the guide surface 14*a* of the guide member 14 with the leading end Fa facing toward the serging station 12. The trouser-fly piece F guided by the guide surface 14*a* extends along an inclined path extending at an angle relative to the path L of movement of the trouser-fly piece F being advanced by the serging unit 11.

Time point $P_1$ in the time chart of FIG. 3 represents a standby position in which all of the operating members of the apparatus 10 are held inoperative. Then, the trouser-fly piece F is advanced longitudinally along the guide surface 14*a* in the direction indicated by the arrow Y in FIG. 2 until the leading end Fa of the trouser-fly piece F is sensed by the end sensor 24 as indicated by time point $P_2$ in the time chart. At this time point, however, the end sensor 24 is arranged to remain inoperative pending arrival of the leading end Fa of the trouser fly piece F at the start-up sensor 27.

Time point $P_3$ represents arrival of the leading end Fa at the edge sensor 26, in which instance however the edge sensor 26 still remains inoperative. A further advancement of the trouser-fly piece F brings its leading end Fa into contact with the start-up sensor 27 as indicated by time point $P_4$, whereupon the start-up sensor 27 sends an electrical signal to the controller to start the serging unit drive or motor, thus the operation of the serging unit 11.

Designated at $t_1$ between time points $P_4$ and $P_5$ is a time delay provided as by a timer for allowing the operator to check if the trouser-fly piece F is properly set with respect to the serging unit 11. With actuation of the drive for the serging unit 11 at time point $P_5$, the trimming cutter 13 starts trimming a corner of the leading end Fa of the trouser-fly piece F along the substantially arcuate trimming line Fy (FIG. 4) and substantially at the same time, the serging unit 11 starts forming an overedge or serge stitching S (FIG. 4) on the arcuate end portion Fx of the trouser-fly piece F. With the serging unit 11 thus in operation, the edge sensor 27 is put in operative condition so that it monitors the presence ("off") and the absence ("on") of the trouser-fly piece F and sends a signal to the controller to actuate the cylinder 23 to lower or raise the presser ball 20, as the case may be, during the serging of the arcuate end portion Fx of the trouser-fly piece F over a period of time $P_7$ between time point $P_5$ and time point $P_8$, during which time the control counter counts the number of strokes of the needle 16. Designated at $t_2$ is a normal time delay (from $P_5$ to $P_6$) peculiar to an electric control system. Upon completion (time point $P_8$) of the serging of the arcuate end portion Fx of the trouser-fly piece F as dictated by the control counter, the edge sensor 27 and hence the cylinder 23 operatively associated therewith are put in "off" condition; namely, out of service and need not continue operation unless a situation arises to the contrary, because the trouser-fly piece F after being arcuately serged is guided automatically by coaction of the feed dog 17 and the presser foot 18 to move substantially linearly along the straight path L of movement. The trouser-fly piece F thus continues advancement through the serging station 12 along the straight path L, during which time the longitudinal side edge Fc of the trouser-fly piece F is serged over a period of time spanning between time points $P_8$ and $P_9$.

Figure 5:
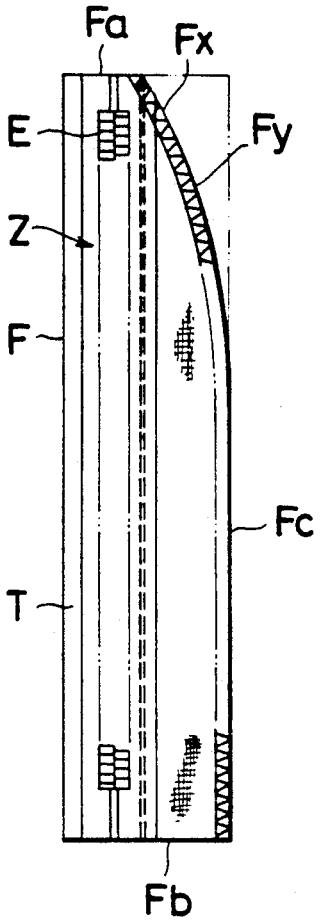
FIG. 5 is a plan view of the trouser-fly piece after it is finished by the apparatus of the invention.
Figure 6:
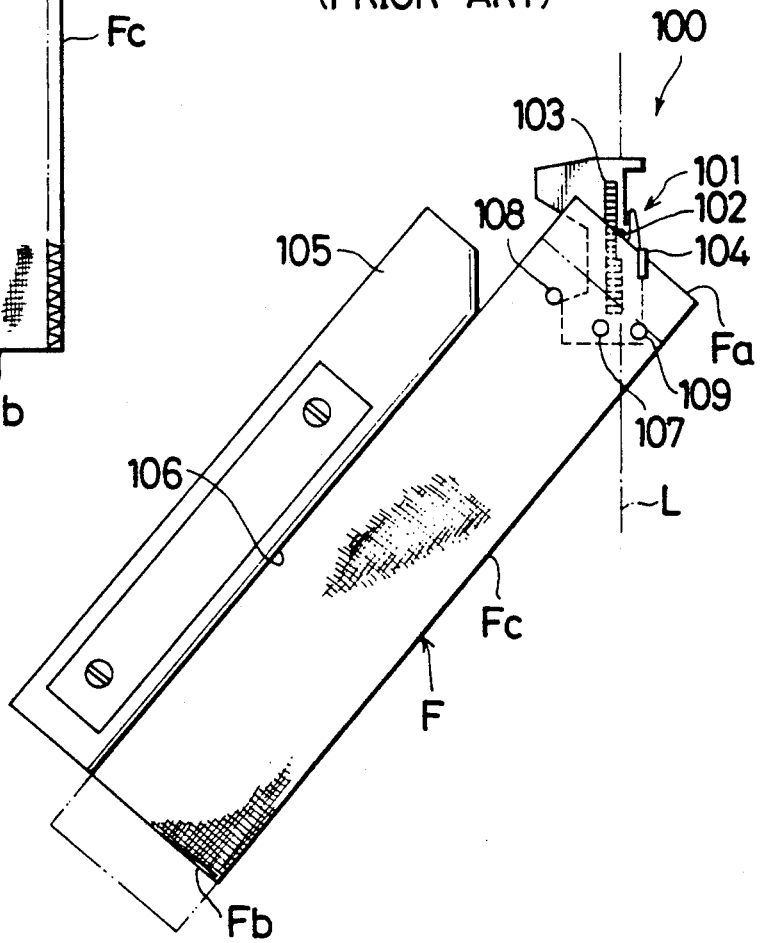
FIG.6 (PRIOR ART)
FIG. 6 is a view similar to FIG. 2 but showing a prior art counter part.
Figure 8:
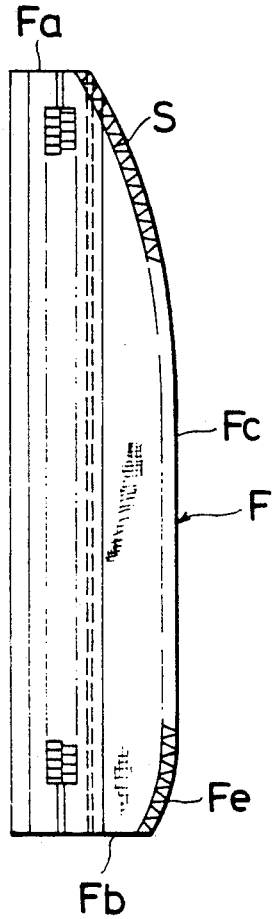
FIG. 8 (PRIOR ART)
FIG. 8 is a plan view of the trouser-fly piece after it is finished by the prior art apparatus.
Figure 7:
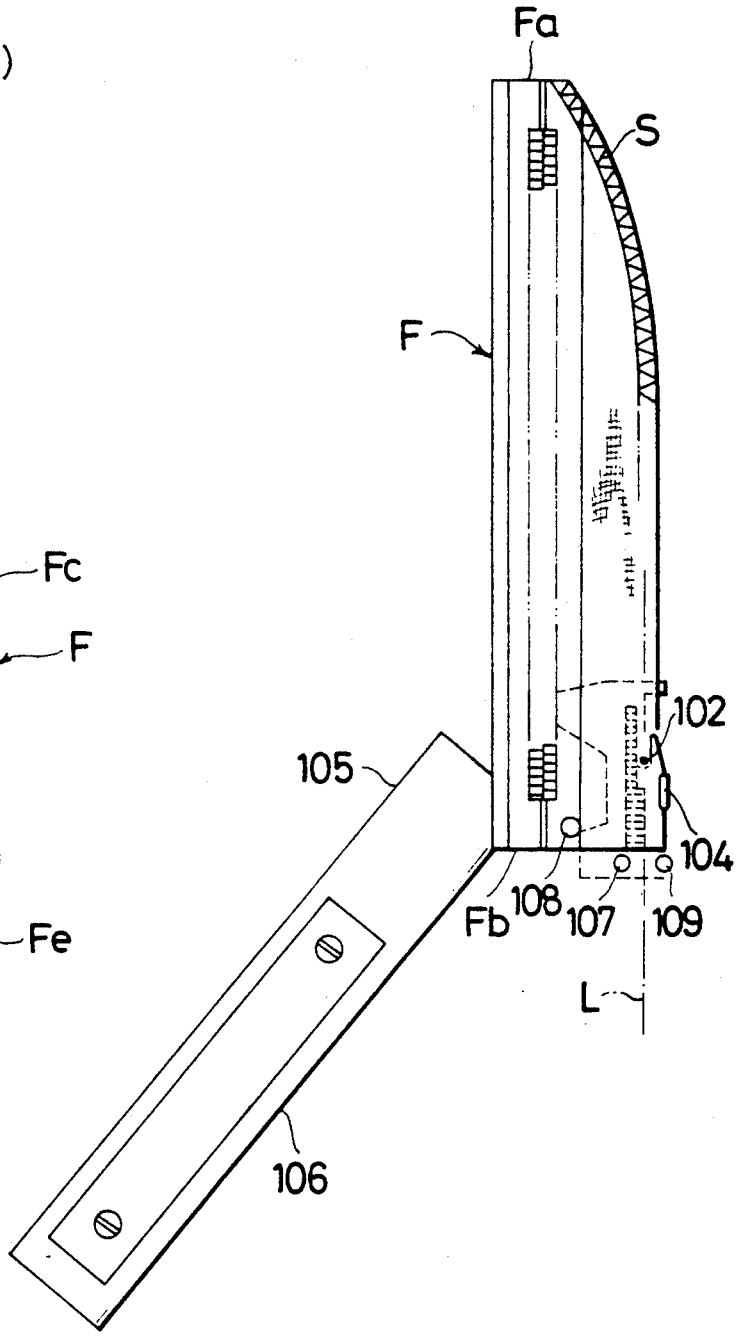
FIG. 7 (PRIOR ART)
FIG. 7 is a schematic plan view showing a trouser-fly piece being serged along its longitudinal side edge on the prior art apparatus.

A further advancement of the trouser-fly piece F causes the trailing end Fb to arrive at the position of the end sensor 24 (time point $P_9$), whereupon the end sensor 24 issues a signal to the controller to start the delay counter. The straight serging operation further continues until the number of strokes of the needle 16 counted by the delay counter is equal to the preset value (ten strokes) corresponding to a time duration N of from time point $P_9$ to time point $P_{10}$ as indicated in the time chart of FIG. 3. The trouser-fly piece F is completely serged with the stitching S over the full length thereof. Subsequently, the delay counter issues a signal to stop operation of the serging unit 11. Thus, a trouser-fly piece F with its arcuate end portion Fx and straight longitudinal side edge Fc serged with the serge stitching S is produced as shown in FIG. 5. Then, the next trouser-fly piece is supplied to the guide member 14 and the foregoing sequences of steps of operation is repeated.

What is claimed is:

1. A trouser fly piece serging apparatus which comprises:

a serging unit defining a serging station and including means for advancing an elongate rectangular trouser fly piece longitudinally through the serging station and a sewing needle for serging a substantially arcuate end portion and subsequently a substantially straight longitudinal side edge of the trouser-fly piece with a serge stitching during advancing movement of the the trouser-fly piece;

a trimming cutter disposed immediately upstream of the serging station and operative in synchronism with the serging unit for trimming, in advance of serging by the needle, the rouser-fly piece along said substantially arcuate trimming line and subsequently along said substantially straight longitudinal side edge;

a guide member disposed upstream of said serging station and having a guide surface extending at such an angle relative to a path of advancement of the trouser-fly piece that the guide surface and the path of advancement of the trouser-fly piece converge toward the serging station for guiding the trouser-fly piece into the serging station so that said trimming cutter assumes a position to conform to a curvature of said arcuate trimming line;

a presser means disposed upstream of said serging station for causing the trouser-fly piece to run in a direction to separate the trouser-fly piece from said guide surface until the trouser-fly piece is oriented to move parallel to a straight line of a path of advancement extending linearly in alignment with said needle;

a trouser-fly piece end sensor disposed upstream of said serging station for sensing both said leading end and a trailing end of the trouser-fly piece;

a trouser-fly piece edge sensor disposed upstream of said serging station for sensing a longitudinal side edge of the trouser-fly piece and issuing an electrical signal to actuate said presser means;

a start-up sensor disposed in close proximity to and upstream of said trimming cutter for sensing the leading end of the trouser-fly piece being advanced into said serging station and issuing an electrical signal to start operation of said serging unit;

a controller for controlling the operation of said serging unit;

a control counter operatively associated with said serging unit, for counting a first predetermined number of strokes of said needle and issuing an electric signal to said controller to hold said edge sensor inoperative when the number of counted strokes of said needle is equal to said first predetermined number; and a delay counter, operatively associated with said serging unit, for counting a second predetermined number of strokes of said needle and issuing an electric signal to said controller to continue operation of said serging unit for a certain period of time after said end sensor has sensed the trailing end of the trouser-fly piece.

2. An apparatus according to claim 1 wherein said first predetermined number of strokes of the needle corresponds to a period of time required to complete serging of said arcuate end portion of the trouser-fly piece,

3. An apparatus according to claim 1 wherein said second predetermined number of strokes of the needle corresponds to a period of time required to complete serging of said longitudinal side edge of the trouser-fly piece.

4. A trouser-fly piece serging apparatus comprising:

a serging unit defining a serging station and including means for advancing an elongate rectangular trouser-fly piece longitudinally through the serging station and a sewing needle for serging the fly piece;

a guide member disposed upstream of said serging station and having a guide surface extending at such an angle relative to a path of advancement of the trouser-fly piece that the guide surface and the path of advancement of the trouser-fly piece converge toward the serging station for guiding the trouser-fly piece into the serging station;

a presser means disposed upstream of said serging station laterally offset from said means for advancing for retarding advancement of one side of the trouser-fly piece, causing the trouser-fly piece to pivot in a direction to separate the trouser-fly piece from said guide surface until the trouser-fly piece is oriented to move parallel to a straight line of a path of advancement extending linearly in alignment with said needle, whereby a substantially arcuate end portion and subsequently a substantially straight longitudinal side edge of the trouser-fly piece is provided with a serge stitching during advancing movement of the trouser-fly piece;

a trouser-fly piece end sensor disposed upstream of said serging station for sensing a trailing end of the trouser-fly piece;

a trouser-fly piece edge sensor disposed upstream of said serging station for sensing a longitudinal side edge of the trouser-fly piece and issuing an electrical signal to actuate said presser means;

a controller means for selectively actuating the operation of said serging unit, said controller means receiving a signal from said end sensor and said edge sensor;

a control counter means for receiving a signal from said serging unit, for counting a first predetermined number of strokes of said needle and issuing an electric signal to said controller to hold said edge sensor inoperative when the number of counted strokes of said needle is equal to said first predetermined number; and a delay counter means for receiving a signal from said serging unit, for counting a second predetermined number of strokes of said needle and issuing an electric signal to said controller to continue operation of said serging unit for a certain period of time after said end sensor has sensed the trailing end of the trouser-fly piece.

5. A trouser-fly piece serging apparatus according to claim 4 further comprising a trimming cutter disposed immediately upstream of the serging station and operative in synchronism with the serging unit for trimming, in advance of serging by the needle, the trouser-fly piece along said substantially arcuate trimming line and subsequently along said substantially straight longitudinal side edge.

6. A trouser-fly piece serging apparatus according to claim 4, wherein said first predetermined number of strokes of the needle corresponds to a period of time required to complete serging of said arcuate end portion of the trouser-fly piece.

7. An apparatus according to claim 4, wherein said second predetermined number of strokes of the needle corresponds to a period of time required to complete serging of said longitudinal side edge of the trouser-fly piece.

* * * * *